United States Patent [19]

Overmyer et al.

[11] 4,089,640

[45] May 16, 1978

[54] FURNACE HOOD WITH INTEGRAL CONVEYOR FEEDING

[75] Inventors: Robert C. Overmyer; Pramodh Nijhawan, both of Indianapolis, Ind.

[73] Assignee: Hawley Manufacturing Corporation, Indianapolis, Ind.

[21] Appl. No.: 745,600

[22] Filed: Nov. 29, 1976

[51] Int. Cl.[2] ..... F27D 17/00

[52] U.S. Cl. ..... 432/73; 13/33; 266/158

[58] Field of Search ..... 432/73; 266/158; 13/33

[56] References Cited

U.S. PATENT DOCUMENTS 3,537,693 8/1977 Bovagne et al. ..... 432/73

FOREIGN PATENT DOCUMENTS 217,490 10/1961 Austria ..... 266/158

*Primary Examiner*—John J. Camby

*Attorney, Agent, or Firm*—Jenkins, Coffey & Hyland

[57] ABSTRACT

A hood for capturing fumes and dust generated during operating of a metal melting furnace including an integral conveyor for charging the furnace. The furnace has an upwardly opening mouth covered by a lid. The hood overlies the lid to capture fumes and dust emanating from the furnace during melting, slagging, pouring, and associated furnace operations. An opening is provided in the hood for insertion of material, e.g., scrap metal, into the furnace. The instant invention includes a conveyor flexibly, e.g., pivotally, mounted between the hood and the lid. The hood opening includes a hopper mounted above the conveyor and opening through the hood into the conveyor. The illustrated system further includes an opening through the furnace lid and a chute adjacent the furnace lid opening for engaging a distal end of the conveyor when the conveyor is moved into a use position. A door is provided to close the distal end of the conveyor when the conveyor is not moving material into the furnace. Another door, which is gravity urged into a closed position, is opened by the conveyor as the conveyor moves from its storage position to its use position. Return movement by the conveyor to its storage position allows this last-mentioned door to close.

16 Claims, 2 Drawing Figures

Figure 2:
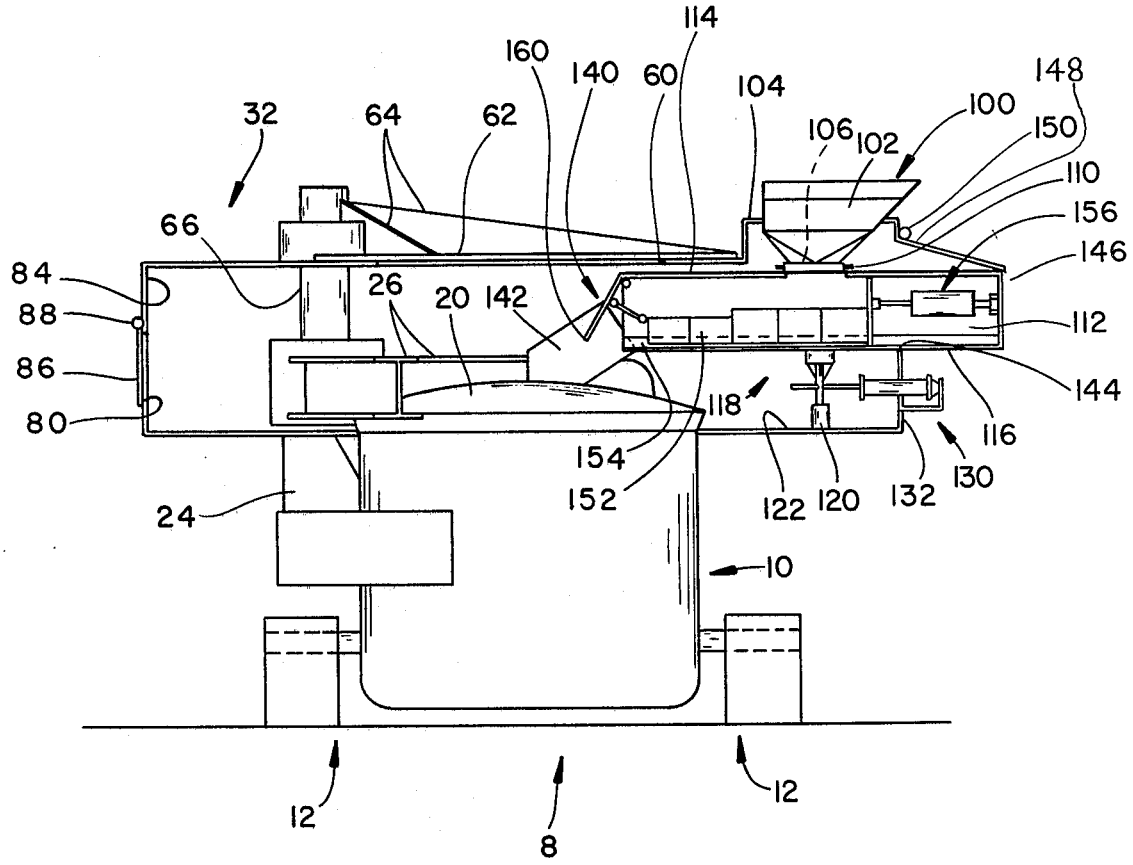

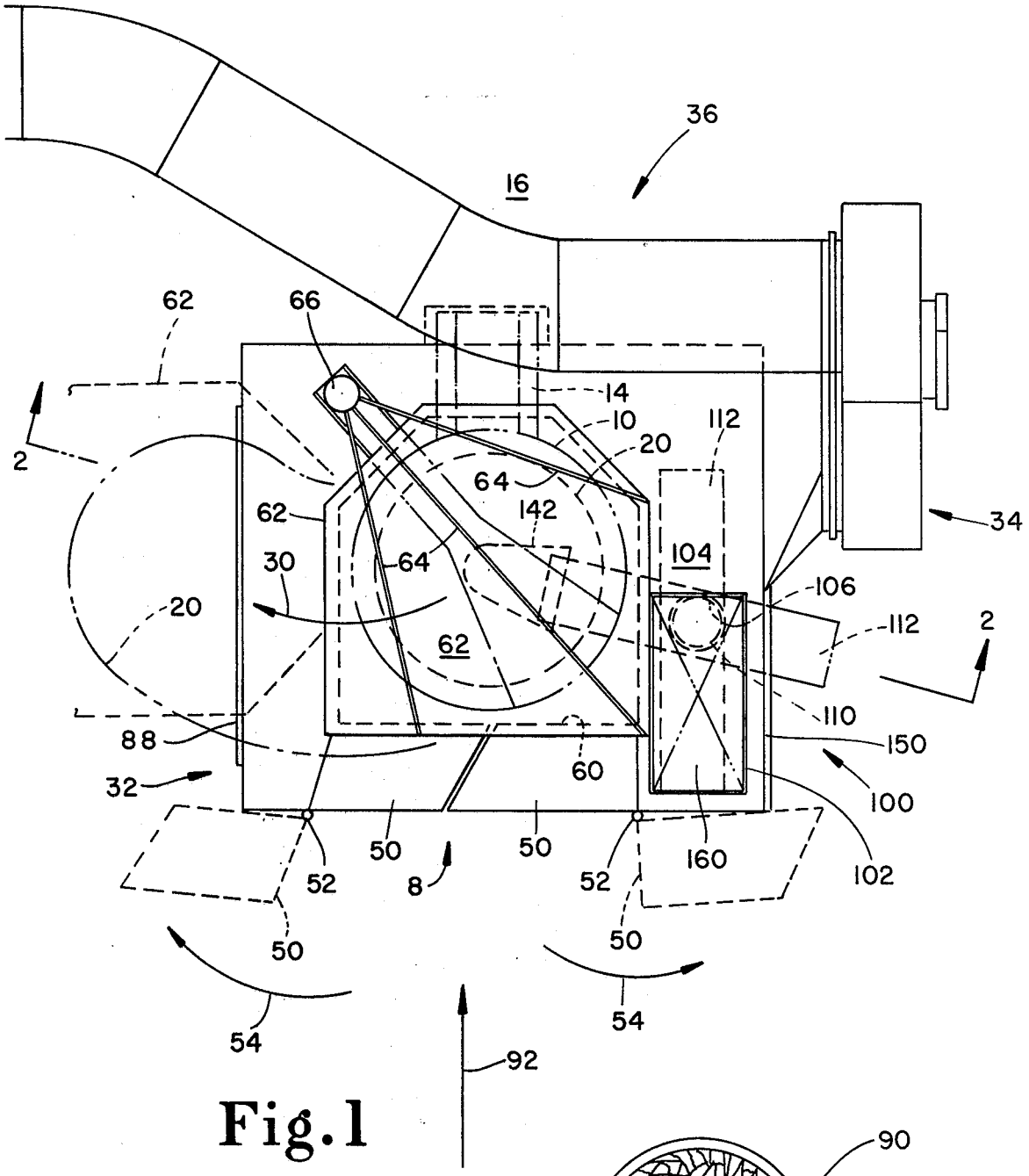
Fig.1
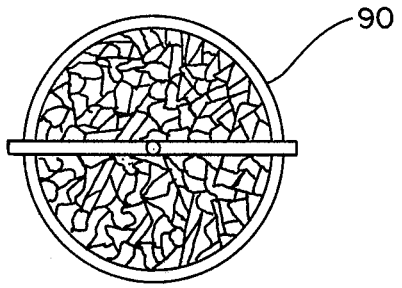

FURNACE HOOD WITH INTEGRAL CONVEYOR FEEDING

This invention relates to exhaust systems for metal melting furnaces and the like, and particularly to a hood for enclosing the upper portion of such a furnace, including the mouth of the furnace. The exhaust hood of the invention incorporates a self-contained charging conveyor having a use position and a storage position, both within the hood.

Fumes control systems for metal melting furnaces and the like are well known. Examples of such systems can be found in the following U.S. Pat. Nos.: 3,930,641 issued Jan. 6, 1976; 3,979,551 issued Sept. 7, 1976; 3,021,376 issued Feb. 13, 1962; 2,908,737 issued Oct. 13, 1959; 2,377,597 issued June 5, 1945; and 2,268,819 issued Jan. 6, 1942. The first two above-mentioned references disclose furnace hood structures including central openings having movable covers which are removed during charging of the furnaces, when the furnace lids are removed. Although such systems achieve excellent results, including capture of most contaminant dust, fumes, etc., generated during furnace charging, it will be appreciated that the large openings in the hoods of such structures during charging operations allow some contaminants to escape.

Accordingly, it is an object of the present invention to provide an improved exhaust system for such applications which can reduce even further the amounts of escaping contaminants during charging operations.

According to the present invention, an improved exhaust system is provided for use with a furnace having an opening through which meterial, e.g., scrap metal, is to be deposited. The improved system includes a hood associated with the furnace and overlying the furnace opening. The hood includes means providing an opening for insertion of the material therethrough. Means are provided for conveying the material from the hood opening to the furnace opening. The conveyor means is disposed within the hood for movement between a use position in which the material is conveyed from the hood opening on the conveyor means to the furnace opening and a storage position in which the conveyor means is out of engagement with the furnace.

Further, according to an embodiment of the invention, the furnace includes an upwardly facing mouth closed by a lid. The lid includes means defining the furnace opening therethrough into the furnace, and a chute surrounding the furnace opening. The conveyor means is movable into its use position engaging the chute for deposition of the material through the furnace opening.

Additionally, according to an embodiment of the invention, the conveyor means is mounted by a swivel connection from the underside of the ceiling of the hood. The hood further includes a hopper, the hood opening being provided at the base of the hopper. The swivel connection is coaxial with the hood opening. The conveyor means includes a first door which opens when material is being conveyed to the furnace opening and is closed at all other times to minimize the escape of fumes and dust from the furnace through the conveyor. The hood also includes a second door which is gravity urged into a closed position and is opened by the conveyor means as it moves from the storage position.

The invention may best be understood by referring to the following description and accompanying drawings which illustrate the invention. In the drawings:

FIG. 1 is a top plan view of a metal-melting furnace, including the furnace hood structure of the present invention and a duct for connecting that structure to a source of suction, alternative positions of several of the hood structure components being illustrated in broken lines; and FIG. 2 is a partial sectional view of the apparatus of FIG. 1 taken generally along section lines 2—2 thereof.

Referring now to the drawings, a metal-melting furnace 8 includes a generally cylindrical crucible 10 mounted upon trunnions 12 (FIG. 2) for tilting movement thereon. Means (not shown) is provided for tilting the crucible on the trunnions to pour molten metal therefrom. A pouring spout 14 (FIG. 1) extends from an opening in the side wall of crucible 10 to a location 16 at which molten metal is poured from furnace 8 into a suitable vessel. The upwardly opening mouth of the crucible 10 is closed by a lid 20 which is generally circular and engages the mouth substantially to seal furnace 8.

As described in the aforementioned U.S. Pat. No. 3,930,641, such a lid 20 is conventionally mounted on a generally vertically extending post 24 (FIG. 2) by means of one or more heavy beam supports 26. Post 24 is connected at its vertically lower end to crucible 10 for tilting movement therewith. Conventional means (not shown) is provided for projecting the post axially upwardly to lift the lid and then pivot the post about its axis to move the lid clockwise out of registry with the mouth, as indicated by arrow 30 of FIG. 1.

As in the device of U.S. Pat. No. 3,979,551, the upper extent of the crucible 10 including the mouth thereof and the lid 20, is surmounted by a hood 32. Hood 32 is coupled by means of connecting swivels and telescoping duct sections, indicated generally by reference numeral 34, to an overhead duct 36. Duct 36 is coupled to a suction source (not shown) and withdraws from hood 32 through connecting sections 34 fumes, dust, etc., generated during the operation of furnace 8.

As best illustrated in FIG. 2, hood 32 is of the close-capture type described and claimed in aforementioned U.S. Pat. No. 3,979,551. Hood 32 is mounted upon crucible 10 for movement therewith as the crucible is tilted for pouring. Connecting swivels and telescoping duct sections 34 allow the hood to remain connected to exhaust duct 36 during such tilting. Hood 32 includes a pair of front-opening doors 50 mounted upon hinges 52 for movement as indicated by arrows 54 in FIG. 1.

Further, as in the aforementioned United States patents, hood 32 includes an upwardly facing top opening 60 closed by a cover 62 during furnace operations. Cover 62 is carried by a plurality of brace supports 64 which are mounted upon an extension 66 of post 24. Extension 66 extends through an opening in the top of hood 32. Extension 66 provides axial and pivotal movement of cover 62 with lid 20, such that when lid 20 is projected axially upwardly and pivoted about the axis of column 24, cover 62 is moved in the same manner.

To allow such movement of lid 20, an elongated slot or opening 80 is provided in a side wall 84 of hood 32. Generally, slot 80 is closed by a door 86 mounted upon a horizontally extending hinge 88 to be gravity urged to its closed position. However, as lid 20 swings into interference with door 86, the door opens upwardly and outwardly, allowing lid 20 to pass through slot 80. The open positions of lid 20 and cover 62 are illustrated in broken lines in FIG. 1.

The described movement of lid 20, doors 50 and cover 62 to open hood 32 and furnace 8 is provided to aid in loading furnace 8 from a charging bucket 90 filled with scrap metal to be melted, as the charging bucket moves along arrow 92 of FIG. 1. This loading method, of course, causes hood 32 to be open for a brief time interval during charging of the furnace 8. During this brief time interval, some of the dust and fumes which can be produced during charging will escape from hood 32. To improve the performance of hood 32 charging operations, apparatus 100 is provided.

Apparatus 100 includes a charging hopper 102 which is mounted in the roof 104 of hood 32 adjacent opening 60. The lower extent of hopper 102 provides a circular opening 106 into the interior of hood 32. A swivel 110 surrounds opening 106 and supports a charging conveyor 112. Charging conveyor 112 in the illustrated embodiment has a generally rectangular cross section. The upper wall 114 of conveyor 112 defines an opening communicating with opening 106 into hopper 102. The lower wall 116 of conveyor 112 includes a bracing and support framework 118 which is mounted upon a pivot 120 supported from the floor 122 of hood 32.

A piston-and-cylinder arrangement 130, e.g., a pneumatic or hydraulic piston and cylinder, is coupled between framework 118 and a side wall 132 of hood 32. Actuation of arrangement 130 in a first direction pivots conveyor 112 into a use position in which the conveyor can be used to charge furnace 8. The use position is illustrated in solid lines in FIG. 2 and in broken lines in FIG. 1. Actuation of arrangement 130 in a second direction pivots conveyor 112 to a storage position, illustrated in broken lines in FIG. 1.

In its use position, the distal end 140 of conveyor 112 engages a chute 142 which is mounted on top of lid 20. Chute 142 surrounds a charging opening (not shown) which extends through lid 20 into the interior of furnace 8. A longitudinally extending opening 144 is provided in side wall 132 to accommodate movement of the proximal end 146 of conveyor 112 as the conveyor moves to its use position. Opening 144 is closed by a door 148 mounted upon a horizontally extending hinge 150 on side wall 132 when conveyor 112 is in its storage position.

The conveyor 112 can be of any desired type, e.g., a belt-type conveyor, an auger-type conveyor, or a plunger- or ram-type conveyor, including its own prime mover. Many suitable types of conveyors for this application are well known. One conveyor type which is well suited to this use is a "harpoon" conveyor such as the one illustrated somewhat diagrammatically in FIG. 2. Such a conveyor includes a harpoon-shaped plunger 152 which is reciprocated longitudinally of the conveyor on a track 154 by a piston-and-cylinder arrangement 156 to convey scrap metal from the hopper opening 106 toward the furnace charging chute 142. Conveyors of this type are available from, for example, Gann Conveyor, Inc. of Indianapolis, Indiana.

Desirably, the conveyor includes a hinged flap or door 160 at the interior end thereof, which door is open only when the conveyor is actuated to convey material into the furnace. When material is not being conveyed, the door 160 closes, preventing the escape of fumes and dust from the furnace through the conveyor and hopper to the atmosphere. The door can be activated to open upon motion of plunger 152 toward the distal end 140 of conveyor 112. The door 160 closes when plunger 152 moves toward end 146 of the conveyor. Door 160 can be actuated from arrangement 156 or may be independently actuable.

The conveyor can be used for loading other materials in addition to, or instead of, metal to be melted. For example, the conveyor can be used solely for conveying additives to the furnace during melting operations, charging being done by the charging bucket 90 through the central aperture 60 in the hood 32 with the furnace lid 20 and cover 60 removed.

What is claimed is:

1. For use with a metal-melting furnace provided with an upwardly facing charging opening for insertion of material therethrough, a hood associated with the furnace and overlying the furnace charging opening, the hood including means providing an opening for passage of material therethrough, the improvement comprising conveyor means for feeding material from the hood opening to the furnace opening, the conveyor means being disposed within the hood.

2. The apparatus of claim 1 wherein the conveyor means is disposed within the hood for movement between a use position in which material is conveyed from the hood opening on the conveyor means to the furnace opening and a storage position in which the conveyor means is out of engagement with the furnace.

3. The apparatus of claim 2 wherein the furnace includes a mouth closed by a lid and the lid includes means defining the furnace opening therethrough into the furnace the conveyor means being movable into its use position in engagement with the furnace opening for deposition of material therethrough.

4. The apparatus of claim 2 wherein the hood includes a ceiling overlying the furnace opening and the conveyor means is flexibly mounted beneath the ceiling for movement between its use and storage positions.

5. The apparatus of claim 4 wherein the means providing the hood opening includes a material hopper.

6. The apparatus of claim 5 wherein the conveyor means is pivotally coupled to the underside of the ceiling beneath, and in open communication with, the material hopper.

7. The apparatus of claim 2 wherein the conveyor means has a distal end engaging the furnace opening in its use position, the distal end having a door movably attached thereto, the conveyor means including means for closing the door when material is not being conveyed to the furnace opening and for opening the door when material is being conveyed to the furnace opening.

8. In combination with a metal-melting furnace provided with an upwardly facing opening for insertion of material into the furnace, a hood associated with the furnace and overlying the furnace opening, the hood including means providing an opening for passage of material therethrough, conveyor means for conveying the material from the hood opening to the furnace opening during furnace operation, the conveyor means being disposed within the hood for movement between a use position in which the material is conveyed from the hood opening on the conveyor means to the furnace opening and a storage position in which the conveyor means is out of material conveying engagement with the furnace opening.

9. The apparatus of claim 8 wherein the furnace includes an upwardly opening mouth closed by a lid.

10. The apparatus of claim 9 wherein the lid includes means defining the furnace opening, the conveyor means including a distal end movable into engagement with the lid opening in the use position for deposition of material through the lid opening.

11. The apparatus of claim 10 wherein the hood includes a ceiling overlying the lid opening and the conveyor means is flexibly mounted beneath the ceiling for movement between its use and storage positions.

12. The apparatus of claim 11 wherein the means providing a hood opening includes a material hopper in open communication with the conveyor means.

13. The apparatus of claim 12 wherein the conveyor means is pivotally coupled to the underside of the ceiling beneath the hopper.

14. The apparatus of claim 8 wherein the hood includes a means defining a door movably attached thereto and urged to a closed position, the conveyor means interfering with the door as the conveyor means moves into its use position, opening the door, the door being gravity urged into its closed position.

15. For use with a furnace providing an upwardly opening mouth, a lid having a position in registry with the mouth for closing the furnace and movable to a position out of registry therewith to open the furnace, a hood for collecting smoke and fumes generated during furnace operations, means coupled to the hood for withdrawing smoke and fumes therefrom, the hood including a ceiling disposed above the lid and an opening allowing passage of material through the ceiling into the interior of the hood, conveyor means for conveying the material from the ceiling opening to the furnace, the conveyor means being disposed beneath the ceiling.

16. The apparatus of claim 15 wherein the conveyor means is disposed for movement between a storage position and a use position in which it conveys the material from the ceiling opening to the furnace.

* * * * *

UNITED STATES PATENT OFFICE

CERTIFICATE OF CORRECTION

Patent No. 4,089,640 Dated May 16, 1978

Inventor(s) Robert C. Overmyer, et al.

It is certified that error appears in the above-identified patent and that said Letters Patent are hereby corrected as shown below:

Column 1, line 35, "material" is misspelled; same column, the last line should read -- veyor means as it moves from the storage position to the use position.

Column 4, line 31, (Claim 3, line 4) after "furnace" a comma should be inserted.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*